US006278860B1

(12) United States Patent
Morganti et al.

(10) Patent No.: US 6,278,860 B1
(45) Date of Patent: Aug. 21, 2001

(54) CASTERED AND GIMBALLED CLEANING WEB WITH SELF-TENSIONING

(76) Inventors: Terry Nate Morganti; David Francis Cahill; James Douglas Shifley, all of Heidelberg Digital L.L.C., 901 Elmgrove Rd., Rochester, NY (US) 14653-6029

( * ) Notice: Subject to any disclaimer, the term of this patent is extended or adjusted under 35 U.S.C. 154(b) by 0 days.

(21) Appl. No.: 09/540,264

(22) Filed: Mar. 31, 2000

(51) Int. Cl.[7] ..... G03G 15/20
(52) U.S. Cl. ..... 399/327
(58) Field of Search ..... 399/327, 320, 399/326, 324, 123, 71, 34, 328, 330, 335, 338; 219/216, 469–471

(56) References Cited

U.S. PATENT DOCUMENTS 3,913,813 * 10/1975 Morse .
3,986,650 * 10/1976 Swanke et al. .
5,450,183 * 9/1995 O'Leary ..... 399/328 X
5,850,588 * 12/1998 Yoshikawa ..... 399/327
5,887,234 * 3/1999 Aslam et al. ..... 399/328 X
5,943,542 * 8/1999 Dalal et al. ..... 399/328 X
6,091,925 * 7/2000 Sugimoto et al. ..... 399/327

* cited by examiner

*Primary Examiner*—Susan S. Y. Lee
(74) *Attorney, Agent, or Firm*—Kevin L. Leffel

(57) ABSTRACT

A mechanism for cleaning the surface of an operative element of a reproduction apparatus. The cleaning mechanism includes an elongated web of cleaning cloth material. A first support provides a supply of the elongated web of cleaning cloth material, and a second support provides a take-up for the elongated web of cleaning cloth material. A back-up member is located in operative association with the element of the reproduction apparatus to be cleaned, the elongated web of cloth material passing over the back-up member in supply of the cloth material from the first support to the second support. A support is provided for the back-up member, which enables caster and gimbal movement of the back-up member to align the back-up member with the element of the reproduction apparatus to be cleaned. A motor is operatively coupled to the second support to drive the second support for selectively advancing the elongated web of cleaning cloth material from the first support to the second support to provide a clean portion of the elongated web of cleaning cloth material to clean the operative element.

9 Claims, 3 Drawing Sheets

CASTERED AND GIMBALLED CLEANING WEB WITH SELF-TENSIONING

CROSS REFERENCE TO RELATED APPLICATIONS

Reference is made to the commonly assigned U.S. patent application Ser. No. 09/473,424, filed concurrently herewith and entitled "CLEANING WEB DETECTOR GAUGE", and the commonly assigned U.S. patent application Ser. No. 09/473,426, filed concurrently herewith and entitled "CLEANING WEB ADVANCEMENT AND DRIVE CONTROL MECHANISM".

FIELD OF THE INVENTION

This invention relates in general to fuser assemblies for reproduction apparatus, and more particularly to a support for a cleaning web for a fuser assembly, where the web is castered and gimballed and is self-tensioning.

BACKGROUND OF THE INVENTION

In typical commercial electrographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly, utilized in typical reproduction apparatus, includes at least one heated roller and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

When the fuser assemblies include an external heater mechanism, a plurality of heater rollers are in contact with the external surface of a fuser roller. The rollers are subject to high loads and high wear of the surface coating. The ideal coating for the rollers would provide low surface energy so as not to attract and retain marking particles while, at the same time, being very resistant to wear in order to provide for long roller life. However, low surface energy coatings are not generally wear resistant in such application. In prior externally heated fuser assemblies, a long-life coating was used, but the fuser assemblies experienced many failures due to contamination. The heater rollers attracted marking particles, became contaminated and subsequently contaminated the fuser rollers. Subsequently, a low surface energy Teflon-type coating was tried, but these rollers also failed early in life when the coating wore off.

Further, with fuser assemblies of the above described type, it has been found that there is a tendency of a portion of the marking particles in an image to adhere to the pressure roller rather than remaining with the receiver member during the fusing operation. This is referred to as image offset. Thereafter the offset marking particles can transfer back to subsequent receiver members being fused to form undesirable image artifacts such as ghost images for example. Also, the offset marking particles may transfer to the fuser roller when no receiver member is present therebetween and then to the back side of subsequent receiver members to form undesirable marks thereon. In order to minimize this image offset effect, an offset preventing oil is applied to the rollers of the fuser assembly. The offset preventing oil has a viscosity which lowers the surface energy of the rollers and makes it less likely that marking particles will adhere thereto.

Since the offset preventing oil is not one hundred percent efficient in preventing image offset, and because the offset preventing oil itself can cause some image artifact problems during fusing, it has been found desirable to provide a mechanism for cleaning the fuser rollers of residual marking particles and excess offset preventing oil. One general type of cleaning mechanism used in reproduction apparatus includes a web cleaner. For example a typical web cleaner is shown in U.S. Pat. No. 4,853,741, issued Aug. 1, 1989, in the name of Ku, for cleaning photoconductive webs. The web cleaner has a roll of cloth material that runs from a supply roll to a take-up roll and is in contact with the surface to be cleaned (e.g., photoconductive web, fuser roller or pressure roller of a fuser assembly, or a transfer roller). The web material is, for example, a thin Nomex web material that is pressed against the heater rollers and wipes any marking particle accumulation from the heater rollers. After a predetermined number of reproductions have been made, the cloth material web is advanced a few degrees to the take-up roll to provide a clean web surface in contact with the surface to be cleaned.

Most web cleaners are rigidly mounted in a frame or slide, which tends to be over-constrained and results in uneven forces along the length. To overcome the over-constrained condition, tight tolerances or non-rigid frames are often employed. However, a non-rigid frame can twist and cause the web to have poor take-up (wrapping on a reel or spool). When the frame is non-rigid the spools may not be parallel which causes the web to track over to the side and eventually bind on the frame. Accordingly it has been found that there is some difficulty in maintaining effective cleaning contact between the cleaning web and the fuser heater rollers.

SUMMARY OF THE INVENTION

In view of the above, this invention is directed to mechanism for cleaning the surface of an operative element of a reproduction apparatus. The cleaning mechanism includes an elongated web of cleaning cloth material. A first support provides a supply of the elongated web of cleaning cloth material, and a second support provides a take-up for the elongated web of cleaning cloth material. A back-up member is located in operative association with the element of the reproduction apparatus to be cleaned, the elongated web of cloth material passing over the back-up member in supply of the cloth material from the first support to the second support. A support is provided for the back-up member which enables caster and gimbal movement of the back-up member to align the back-up member with the element of the reproduction apparatus to be cleaned. A motor is operatively coupled to the second support to drive the second support for selectively advancing the elongated web of cleaning cloth material from the first support to the second support to provide a clean portion of the elongated web of cleaning cloth material to clean the operative element.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
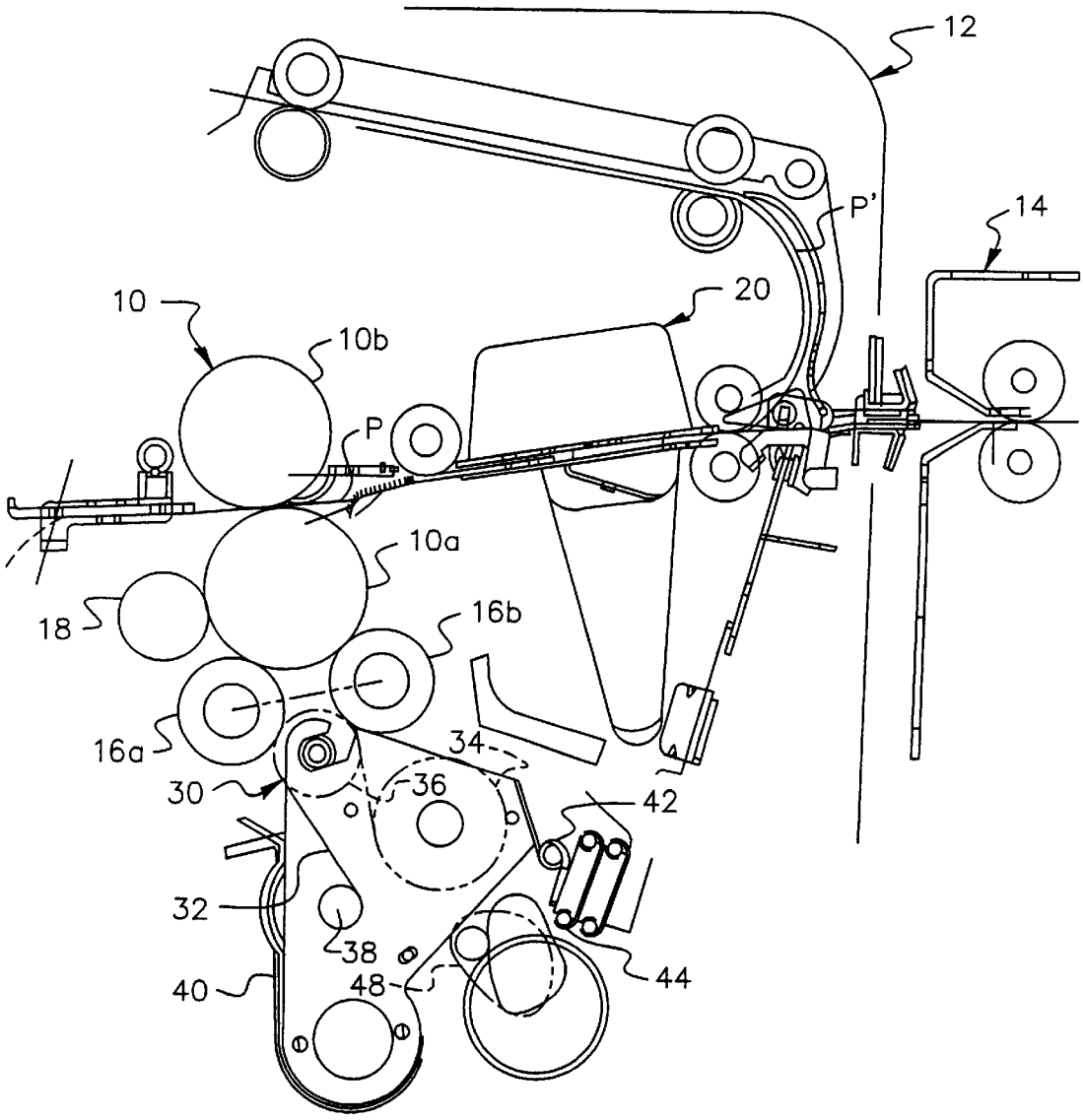
FIG. 1 is a side elevational view of an electrographic reproduction apparatus fuser assembly cleaning mechanism, shown in association with the fuser assembly and the post fuser assembly transport path, with portions broken away or removed to facilitate viewing.
Figure 2:
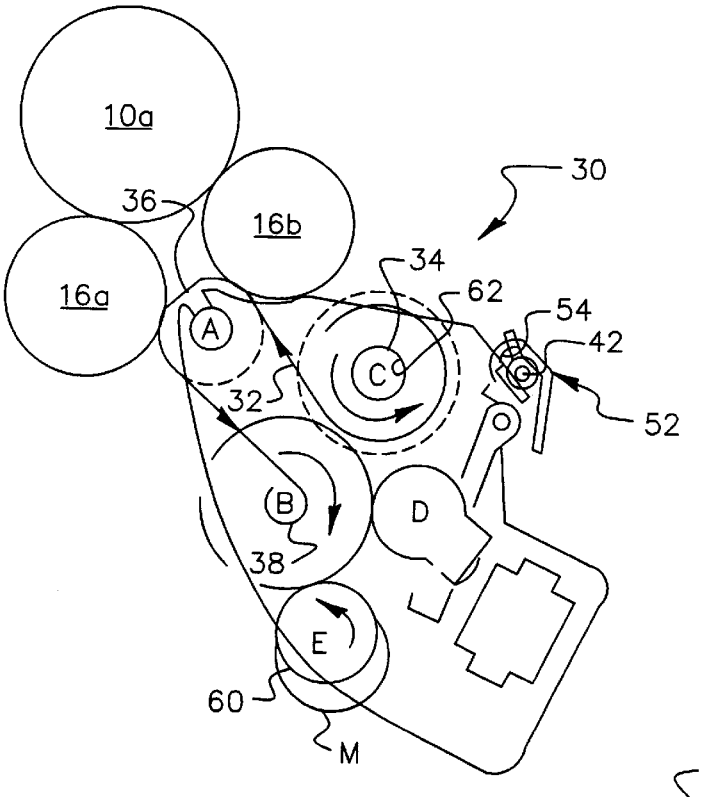
FIG. 2 is a side elevational view on an enlarged scale of the web cleaning device according to this invention, particularly showing the drive therefor.
Figure 3:
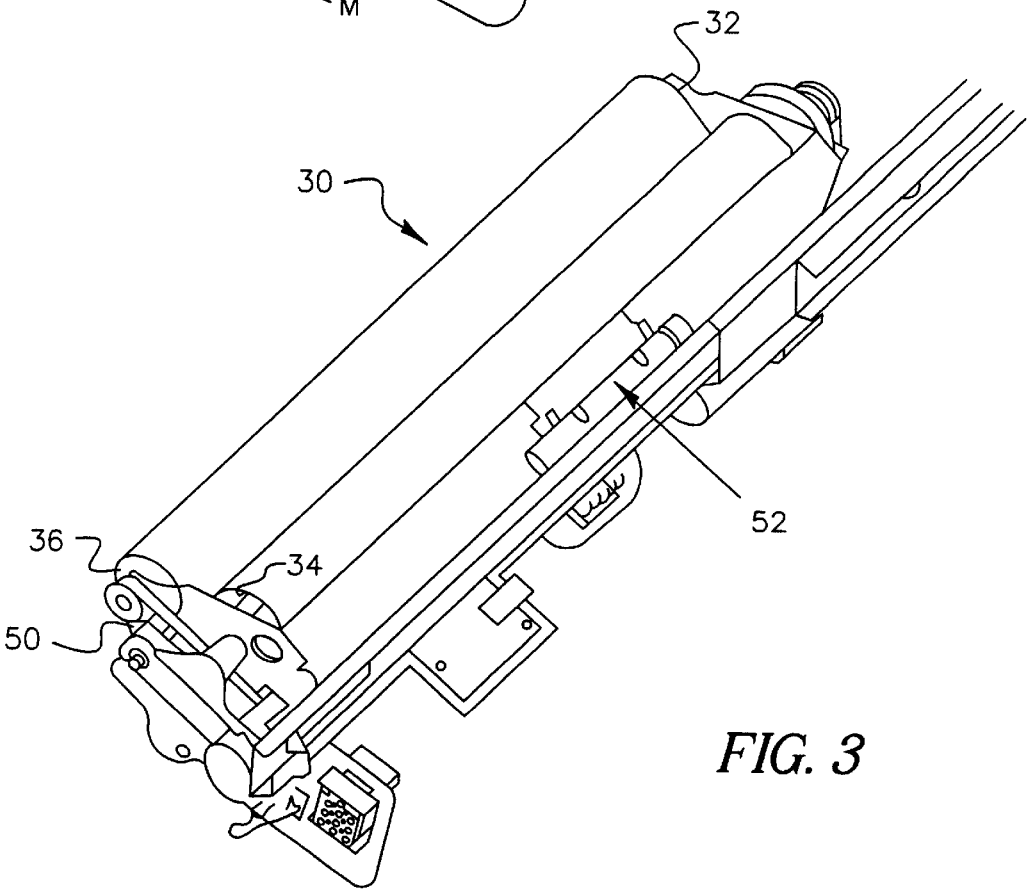
FIG. 3 is a view, substantially in perspective, of the web cleaning device according to this invention.

Referring now to the accompanying drawings, FIGS. 1–3 show an exemplary fuser assembly 10 for an electrographic reproduction apparatus 12 (only a portion of the housing of the reproduction apparatus being shown in the drawings). The fuser assembly 10 includes a heated fusing roller 10*a* in nip relation with a pressure roller 10*b*. The fusing nip between the rollers 10*a*, 10*b* is associated with the transport path P of the reproduction apparatus 12. That is, as a receiver sheet bearing a marking particle image is transported along the path P, the marking particle image is fixed to a receiver sheet by application of heat and pressure in the fusing nip before the receiver sheet is delivered from the transport path P to an output device 14 or a duplex reproduction recirculation path P'. Substantially immediately downstream of the fuser assembly 10, in the direction of receiver sheet travel, is a sheet cooler device, designated generally by the numeral 20, more fully described in co-pending U.S. patent application Ser. No. 09/464,423, filed Dec. 16, 1999, in the names of Kowalski et al. Heat to the fusing roller 10*a* is supplied by a pair of external heater rollers 16*a* and 16*b* in contact with the peripheral surface of the fusing roller. Additionally, an oiler device 18, of any suitable construction well known in the prior art, contacts the fusing roller 10*a* to apply offset preventing oil to the fusing roller.

A web cleaner mechanism, according to this invention, for removing residual marking particles and excess offset preventing oil from rollers of a fuser assembly, is shown in a preferred embodiment in the drawings designated by the numeral 30. The web cleaner mechanism 30 has an elongated cleaning material cloth web 32 located in an operative position to contact the heater rollers 16*a*, 16*b*. Of course, the mechanism 30 could also be arranged, without departing from this invention, such that the cloth web directly contacts the fusing roller 10*a*, the pressure roller 10*b*, or for example any other assembly within the reproduction apparatus 12 to be cleaned (e.g., transfer roller, photoconductor, etc.).

The cleaning material cloth web 32 of the cleaning mechanism 30 is supported on a supply reel 34, rides over a foam roller 36, and is connected to a take-up reel 38 (see FIG. 2). The supply reel 34, the roller 36, and the take-up reel 38 are mounted in operative association on a rigid frame 40. The rigidity of the frame 40 enables straight wrapping of web. A wide area of contact (for example, greater than 0.100" wide) along the entire length of the heater rollers 16*a*, 16*b* was found to remove any small accumulations of marking particles and excess offset preventing oil from the rollers and prevent contamination. To achieve the desired contact area, the high temperature silicone foam roller 36 acts as a back-up roller for the web 32. The web 32 is wrapped over the back-up roller 36, and the back-up roller is urged into contact with the heater rollers 16*a*, 16*b*, for example by a spring mechanism 50 (see FIG. 3). When a force is applied to the back-up roller 36 in engagement with the heater rollers 16*a*, 16*b*, the back-up roller compresses and forms the desired wide nip. In order to create a cost-effective arrangement, one foam roller is used for back-up against both heater rollers. As such, the one back-up roller must contact the two heater rollers simultaneously and uniformly. According to this invention, a castered and gimballed mount permits the rigid frame to be used while still providing an equal and uniform web nip for uniform pressure along the length of both heater rollers 16*a*, 16*b* simultaneously.

As described above, the supply reel 34, the foam back-up roller 36, and the take-up reel 38 are mounted in operative relation on the rigid frame 40. The frame 40 is, in turn, supported on pivot pins 42 connected to a guide rail 44. The support of the frame 40 on the pivot pins 42 enables the frame to move about the longitudinal axis of the pivot rod and along the longitudinal axis of the pivot rod. That is, the frame 40 can move with the guide rail 44 in a direction along the longitudinal axis of the pivot pins 42 to locate the frame (and thus the cleaning mechanism 30) in operative association with the fuser assembly 10, or at a location external to the reproduction apparatus 12 so that the cleaning mechanism can be easily serviced or the cloth web 32 readily replaced. The web is only engaged with the heater rollers 16*a*, 16*b* when the fuser assembly 10 is in the mode for fusing images. It is lowered away from the heater rollers during idle periods. When the web 32 is in the lowered position, it must be restrained so it hangs parallel to the fuser assembly and does not tip or interfere with other reproduction apparatus components. A loose fitting hinge 52 is used to support the cleaning mechanism 30 with two pivot pins 42 (only one shown in the drawings) supported in large loose fitting slots 54 near the center. This provides for the web 32 to be supported substantially horizontally when hanging in the idle period, yet be free to move when engaged with the heater rollers 16*a*, 16*b*.

Caster movement is achieved by the angle of the hinge slot 54 in relation to gravity and load forces. The average resultant forces were used to determine the optimum slot angle that would support the web 32 so that the contact force on the back-up roller 36 with the heater rollers 16*a*, 16*b* was approximately equal in the front and rear of both of the heater rollers. Gimbal movement is achieved by balancing the forces perpendicular to the slot 54 and keeping the respective pivot pin slots narrow when compared to the long overall length of the heater rollers and web. Further, when the rigid frame 40 is located in the interior of the reproduction apparatus 12, the frame can be moved about the longitudinal axis of the pivot pins 42 by, for example, the cam mechanism 48. As such, the cloth web can be located in operative cleaning engagement with the heater rollers 16*a*, 16*b* of the fuser assembly 10, or remote from engagement with the heater rollers.

Figure 4:
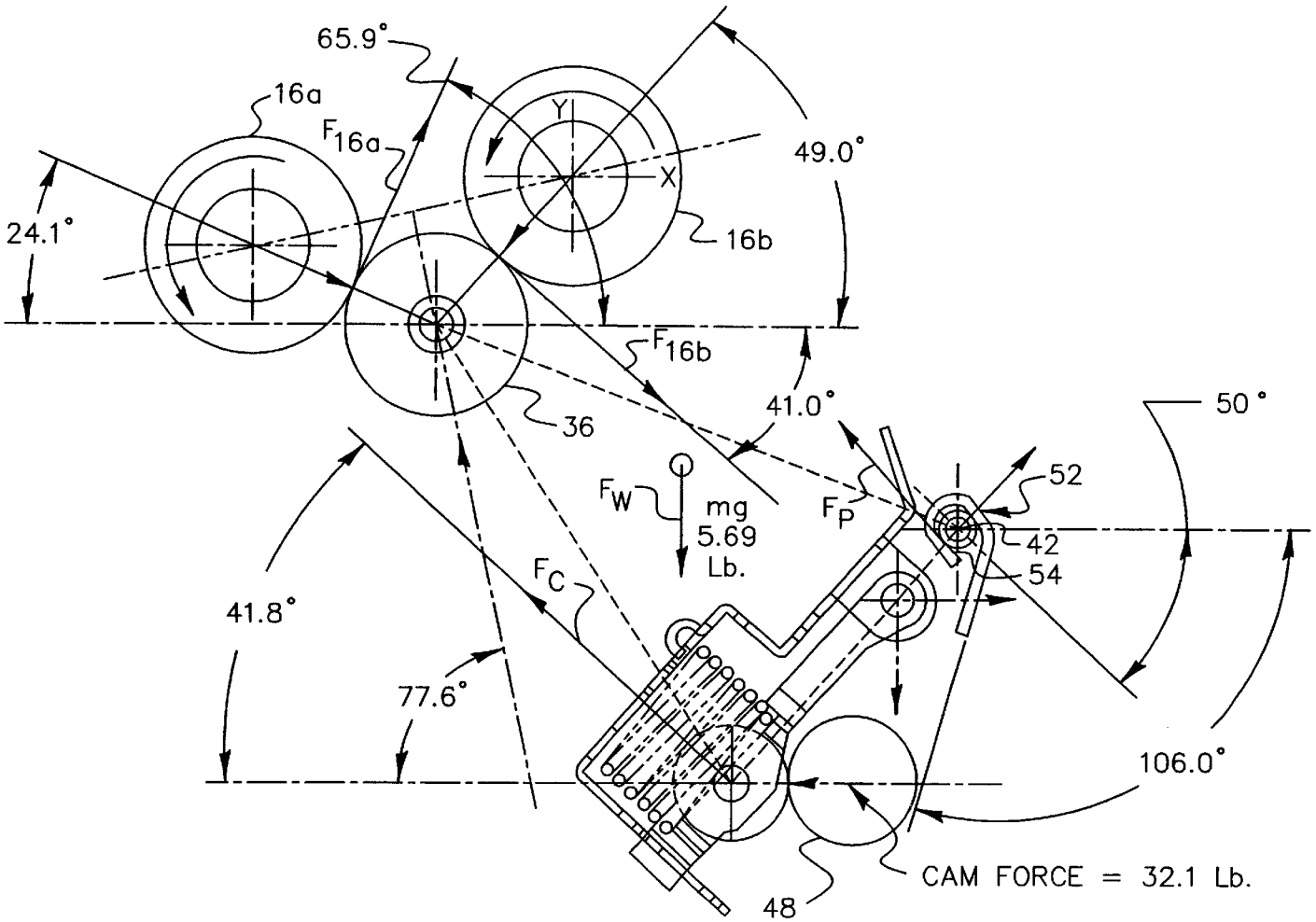
FIG. 4 is a side elevational view, on an enlarged scale of the web cleaning device according to this invention, showing the balance of forces on the web cleaning device.

A three-dimensional balance of the forces on the web assembly cleaning mechanism 30 was used to develop the desired arrangement. As shown in FIG. 4, the components of the forces include a frictional force $F_{16a}$ representative of the force on the web 32 from the heater roller 16*a* (left most heater roller shown in FIG. 4). The average of the front force, and the average of the rear force were used. A frictional force $F_{16b}$ is representative of the force on the web 32 from the heater roller 16*b* (left most heater roller shown in FIG. 4). The average of the front force, and the average of the rear force were used. The force $F_w$ represents the force due to the weight of the web assembly 30. It should be noted that this force changes as the web 32 is transferred from the supply spool 34 to the take-up spool 38. The force $F_p$ represents the force of the pivot hinge 52 on the web assembly at the front pivot pin 42 and rear pivot pin. The force $F_c$ represents the force of the actuation cam mechanism 48 on the web assembly.

The material cloth web 32 of the cleaning mechanism 30 must be periodically advanced so to have clean material present at the heater rollers 16*a,* 16*b* to efficiently clean such rollers (or any other assembly with which the cleaning mechanism according to this invention is suitably associated). The material cloth web 32 is advanced in a manner which will enable accurate usage of the material, detect a failure of the material, and permit the amount of incremental advancement of the web to be easily changed. The web 32 is efficient at accumulating marking particles and excess fuser oil up until it becomes fully saturated. Because only a small amount of marking particles is present on the heater roller at any time, one section of the web can remain against the heater roller for many images until it is necessary to advance the web to a new, clean location. The web remains stationary for a preselected number of images and is then advanced a predetermined amount to a new clean area.

In order to provide for proper tensioning and advancement of the cleaning web 32 of the cleaning mechanism 30, the cleaning web material is wound on the supply reel 34, and attached to an empty take-up reel 38. The web 32 travels from the supply reel, over the top of the back-up roller 36 and onto the take-up reel. A motor M (see FIG. 2) and gear train 60 are used to drive the take-up reel 38, and wind the web material onto the take-up reel. High friction forces imparted to the web 32, generated by the contact of the web with the heating rollers 16*a,* 16*b,* act in a direction which attempts to pull the web off the take-up reel. Accordingly, motor M is for example a gear reduction motor providing a substantial resisting force, and thus resistance to undue unwinding of the web from the take-up reel 38. The supply reel 34, on the other hand, is not subjected to friction forces during normal operation of the cleaning mechanism 30, but must also be kept from undue unwinding for example as a result of general handling or in the event that the web 32 sticks to the heater rollers 16*a,* 16*b* being cleaned.

Therefore, an over-running spring-wrap clutch 62 is included in the drive for the supply reel 34. The clutch 62 is arranged to provide a force for stopping the supply reel 34 from rotating in a direction which would enable the web 32 to unwind from the reel 34, and also provides an additional backward winding feature (i.e., rewinds web on the supply reel). Thus, whenever the take-up spool gears are turned, the gear train turns the supply reel 34 backwards (counter-clockwise in FIG. 2) to rewind any loose web material quickly on the supply reel. Once the web is tight, the over-running spring-wrap clutch 62 on the supply reel will slip. This action provides a continuing force balance where the motor M drives the take-up reel in a direction trying to wind the web on the take-up reel 38. If the web 32 is tight, the clutch 62 slips, negating the backwards drive of the web onto the supply reel 34, and allows the take-up reel 38 to pull web material off the supply reel. This feature aids in quickly tensioning the web 32 should it become loose due to stretching or not having been tightened after replacement.

The invention has been described in detail with particular reference to certain preferred embodiments thereof, but it will be understood that variations and modifications can be effected within the spirit and scope of the invention.

What is claimed is:

1. A mechanism for cleaning the surface of an operative element of a reproduction apparatus, said cleaning mechanism comprising:

an elongated web of cleaning cloth material;

a first support which provides a supply of said elongated web of cleaning cloth material, and a second support which provides a take-up for said elongated web of cleaning cloth material;

a back-up member located in operative association with said element of said reproduction apparatus to be cleaned, said elongated web of cloth material passing over said back-up member in supply of said cloth material from said first support to said second support, said first support, said second support, and said back-up member are supported in operative association in a rigid frame;

a support for said rigid frame which enables caster and gimbal movement of said rigid frame to align said back-up member with said element of said reproduction apparatus to be cleaned to provide an equal and uniform web nip with said element of said reproduction apparatus; and a motor operatively coupled to said second support to drive said second support for selectively advancing of said elongated web of cleaning cloth material from said first support to said second support to provide a clean portion of said elongated web of cleaning cloth material to clean said operative element.

2. The cleaning mechanism according to claim 1 wherein said first support is a first reel, and said second support is a second reel spaced from said first reel.

3. The cleaning mechanism according to claim 2 wherein an over-running spring-wrap clutch is connected to said first reel for selectively preventing rotation of said first reel to maintain desired tension in said elongated web of cleaning cloth material and urge said second reel in a direction to rewind said elongated web thereon.

4. The cleaning mechanism according to claim 2 wherein said motor is a positive drive, gear reduction motor providing a substantial resisting force connected to said second reel for selectively rotating said second reel to wind said elongated web of cleaning cloth material thereon.

5. The cleaning mechanism according to claim 2 wherein an over-running spring-wrap clutch is connected to said first reel for selectively preventing rotation of said first reel to maintain desired tension in said elongated web of cleaning cloth material and urge said second reel in a direction to rewind said elongated web thereon; and wherein said motor is a positive drive, gear reduction motor providing a substantial resisting force connected to said second reel for selectively rotating said second reel to wind said elongated web of cleaning cloth material thereon.

6. In a reproduction apparatus having a fuser assembly including a fuser roller and a pair of external heating rollers in operative contact with such fuser roller, said heating rollers requiring periodic cleaning so that said reproduction apparatus operates at peak efficiency, a mechanism for cleaning the surface of said heating rollers, said cleaning mechanism comprising:

a first reel which provides a supply of elongated web of cleaning cloth material, and a second reel which provides a take-up for said elongated web of cleaning cloth material;

a back-up member located in operative association with said heating rollers to be cleaned, said elongated web of cloth material passing over said back-up member in supply of said cloth material from said first reel to said second reel, said first reel, said second reel, and said back-up member being supported in operative association in a rigid frame;

a support for said rigid frame which enables caster and gimbal movement of said rigid frame to align said back-up member with said heating rollers to provide an equal and uniform web nip with said heating rollers; and a motor operatively coupled to said second reel to drive said second reel for selectively advancing of said elongated web of cleaning cloth material from said first reel to said second reel to provide a clean portion of said elongated web of cleaning cloth material to clean said heating rollers.

7. The cleaning mechanism according to claim 6 wherein an over-running spring-wrap clutch is connected to said first reel for selectively preventing rotation of said first reel to maintain desired tension in said elongated web of cleaning cloth material and urge said second reel in a direction to rewind said elongated web thereon.

8. The cleaning mechanism according to claim 6 wherein said motor is a positive drive, gear reduction motor providing a substantial resisting force connected to said second reel for selectively rotating said second reel to wind said elongated web of cleaning cloth material thereon.

9. The cleaning mechanism according to claim 6 wherein an over-running spring-wrap clutch is connected to said first reel for selectively preventing rotation of said first reel to maintain desired tension in said elongated web of cleaning cloth material and urge said second reel in a direction to rewind said elongated web thereon; and wherein said motor is a positive drive, gear reduction motor providing a substantial resisting force connected to said second reel for selectively rotating said second reel to wind said elongated web of cleaning cloth material thereon.

* * * * *